US005441357A

United States Patent [19]

Wilson

[11] Patent Number: 5,441,357

[45] Date of Patent: Aug. 15, 1995

[54] CASE MADE RING BINDER AND METHOD OF FABRICATING SAME

[75] Inventor: Robert B. Wilson, S. Hadley, Mass.

[73] Assignee: Avery Dennison Corporation, Pasadena, Calif.

[21] Appl. No.: 133,385

[22] Filed: Aug. 27, 1993

[51] Int. Cl.[6] ..... B42F 3/02

[52] U.S. Cl. ..... 402/75; 281/29

[58] Field of Search ..... 402/73, 74, 75, 76, 402/77, 78, 502; 281/29, 36, 37

[56] References Cited

U.S. PATENT DOCUMENTS

| | | | |
|---|---|---|---|
| 1,983,883 | 12/1934 | Schade | 402/75 |
| 3,190,678 | 6/1965 | Peterson et al. . | |
| 3,215,450 | 11/1965 | Peterson et al. | 281/29 |
| 3,277,505 | 10/1966 | Peterson et al. . | |
| 4,289,330 | 9/1981 | Wiermanski | 281/29 |
| 4,583,877 | 4/1986 | Wilson | 402/75 |
| 4,600,346 | 7/1986 | Podosek | 412/3 |
| 5,160,209 | 11/1992 | Schuessler | 402/75 |

*Primary Examiner*—Hwei Siu Payer
*Attorney, Agent, or Firm*—Kriegsman & Kriegsman

[57] ABSTRACT

A case made ring binder for holding a plurality of loose-leaf papers or the like and a method of fabricating the same. In one embodiment, the case made ring binder comprises three rectangular, spaced apart, stiffener panels arranged as a front cover panel, a rear cover panel and a spine panel, respectively. An oversized, rectangular cover sheet is affixed to the outside surfaces of the three stiffener panels using a dry, heat-actuable adhesive, and the four marginal edges of the cover sheet are turned over the corresponding edges of the three stiffener panels. A wet glue is then used to affix the inturned edges overlying the front and rear cover panels to the inside surfaces thereof. A flat backplate having means for mounting a conventional ring mechanism is then affixed to the inside surface of the spine panel using a dry, heat-actuable adhesive. Next, an inside liner sheet which is appropriately dimensioned to overlie the four inturned edges of the cover sheet and the exposed portions of the front cover panel, rear cover panel and backplate, is affixed thereto using a dry-heat actuable adhesive. At the same time, the backplate and spine panel are made curved. The liner sheet comprises a paper-based substrate and a plastic film applied to the top surface of the paper-based substrate to provide reinforcement thereto. Finally, a ring mechanism is fixedly attached to the backplate.

13 Claims, 3 Drawing Sheets

CASE MADE RING BINDER AND METHOD OF FABRICATING SAME

BACKGROUND OF THE INVENTION

The present invention relates generally to non binders and more particularly to case made ring binders.

Ring binders, also colony referred to as loose-leaf binders, have been used for many years to bind together sheets of paper and the like. One common type of ring binder is fabricated by heat-sealing three rigid or semi-rigid, rectangular inserts or stiflenet panels between two superimposed sheets of thermoplastic material. Of the three stiflenet panels generally used, two of them approximate in size the back and front covers of the binder and the third panel is a narrower insert disposed between the two large panels for use in forming the spine of the binder. The inner and outer plastic sheets are fused together or heat-sealed around their peripheral edges and also transversely between the adjacent, transverse edges of the cover panels and the spine panel. The transverse seals for the hinges for the binder cover and the peripheral edge seals provide the finished edges thereof. A ring binder mechanism is typically affixed to the spine of the binder cover.

Binders of the type described above are disclosed in U.S. Pat. No. 4,583,877 dated Apr. 22, 1986 to Wilson and in U.S. Pat. No. 4,600,346 dated Jul. 15, 1986 to Podosek. Although such binders are generally satisfactory for their intended purpose, they have a tendency wear over time, particularly in the hinge area and around the periphery of the binder cover where the two sheets of thermoplastic material have been used together.

Another common type of ring binder is often referred to as a case made ring binder. Case made ring binders are typically more durable and last longer than the twin thermoplastic sheet binders described above. Ordinarily, to make a case made ring binder, an oversized outer covering sheet is first wet glued onto the outer surfaces of three stiffeners arranged as a front cover panel, a back cover panel and a spine panel. The edges of the outer covering sheet are then turned over the edges of the three panels and wet glued onto the inner surfaces of the front and back cover panels. Next, a backplate having means for mounting a ring mechanism is wet glued onto the inner surface of the spine panel. A spine-reinforcing joint liner having a heat-activated adhesive on its outer surface is then affixed to the inner surface of the backplate and to neighboring portions of the front and back cover panels, as well as to the adjacent inturned edges of the outer cover sheet. Next, a pair of side liners are wet glued over the inturned edges of the outer cover sheet, as well as over portions of the joint liner and the front and back cover panels. Finally, a ring mechanism is fixedly mounted on the backplate.

One shortcoming recognized by the present inventor with case made ring binders is that the method of constructing such binders is not well-suited for automated production techniques. Consequently, such binders are typically made in production lines using the combined efforts of several different people. For example, the application of the joint liner and the pair of side liners is typically performed by three different people, with one person being responsible for applying the joint liner and two additional people being responsible for applying the respective side liners.

Another shortcoming recognized by the present inventor with such binders is that wet glue is typically used at various times in the fabrication procedure to adhere together various components. Because wet glue is typically dispensed using machines that require a great deal of maintenance, time and manpower are frequently misdirected at the cleaning of the glue machines instead of properly directed at the fabrication of binders. Another problem resulting from the use of wet glue is that several heating steps are typically required following the application of wet glue to dissipate the moisture contained therein so that a proper seal may be formed.

Patents pertaining to case made binders include U.S. Pat. No. 3,190,678 dated Jun. 22, 1965 to Peterson et al. and U.S. Pat. No. 3,277,505 dated Oct. 11, 1966 to Peterson et al.

SUMMARY OF THE INVENTION

It is an object of the present invention to provide a new and novel ring binder.

It is another object of the present invention to provide a new and novel case made ring binder.

It is still another object of the present invention to provide a case made ring binder which improves upon at least some of the shortcomings discussed above in connection with existing case made ring binders.

To achieve the purpose of the invention as broadly set forth above, a case made ring binder constructed according to the teachings of the present invention is provided which comprises (a) one or more stiffeners arranged to define a front cover panel, a back cover panel and a spine panel; (b) a generally rectangular cover sheet affixed to the outside (i.e. rear) of said one or more stiffeners, the four edges of said cover sheet being turned over the corresponding edges of said one or more stiffeners; (c) an inside liner sheet appropriately dimensioned so that its marginal edges overlie the four inturned edges of said cover sheet, said inside liner sheet being placed over the inside surface of said one or more stiffeners and affixed to said four inturned edges of said cover sheet; and (d) a ring mechanism attached to said spine panel.

In a preferred embodiment of the invention, the case made ring binder is fabricated with three spaced apart, flat stiffeners arranged as a front cover panel, a spine panel and a rear cover panel, respectively. A dry, heat-actuable adhesive is applied to the respective outside (i.e. rear) surfaces of the three stiffener panels and is used to affix the outer cover sheet thereto. In addition, a dry, heat-actuable adhesive is applied to the inside (i.e. front) surface of the spine stiffener panel and is used to secure a backplate thereto, the backplate being flat and having means for mounting a ring mechanism. Wet glue is used to secure the inturned edges of the cover sheet to the corresponding inside (i.e. front) periphery of the front cover stiffener panel and the rear cover stiffener panel. The inside liner sheet includes a paper-based substrate and a plastic reinforcing film, the reinforcing film being applied to the inside (i.e. front or top) surface of the paper-based substrate. A dry, heat-actuable adhesive is applied to the outside (i.e. rear or bottom) surface of the liner sheet and is used to fix the liner sheet to the inturned edges of the cover sheet, as well as to the underlying exposed portions of the front cover stiffener panel, the rear cover stiffener panel and the backplate. As the heat-actuable adhesive is being activated, the backplate and spine stiffener panel are made curved using a heated press. The ring mechanism is then fixedly mounted on the backplate.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings wherein like reference numerals represent like parts.

DETAILED DESCRIPTION OF PREFERRED EMBODIMENTS

Figure 1:
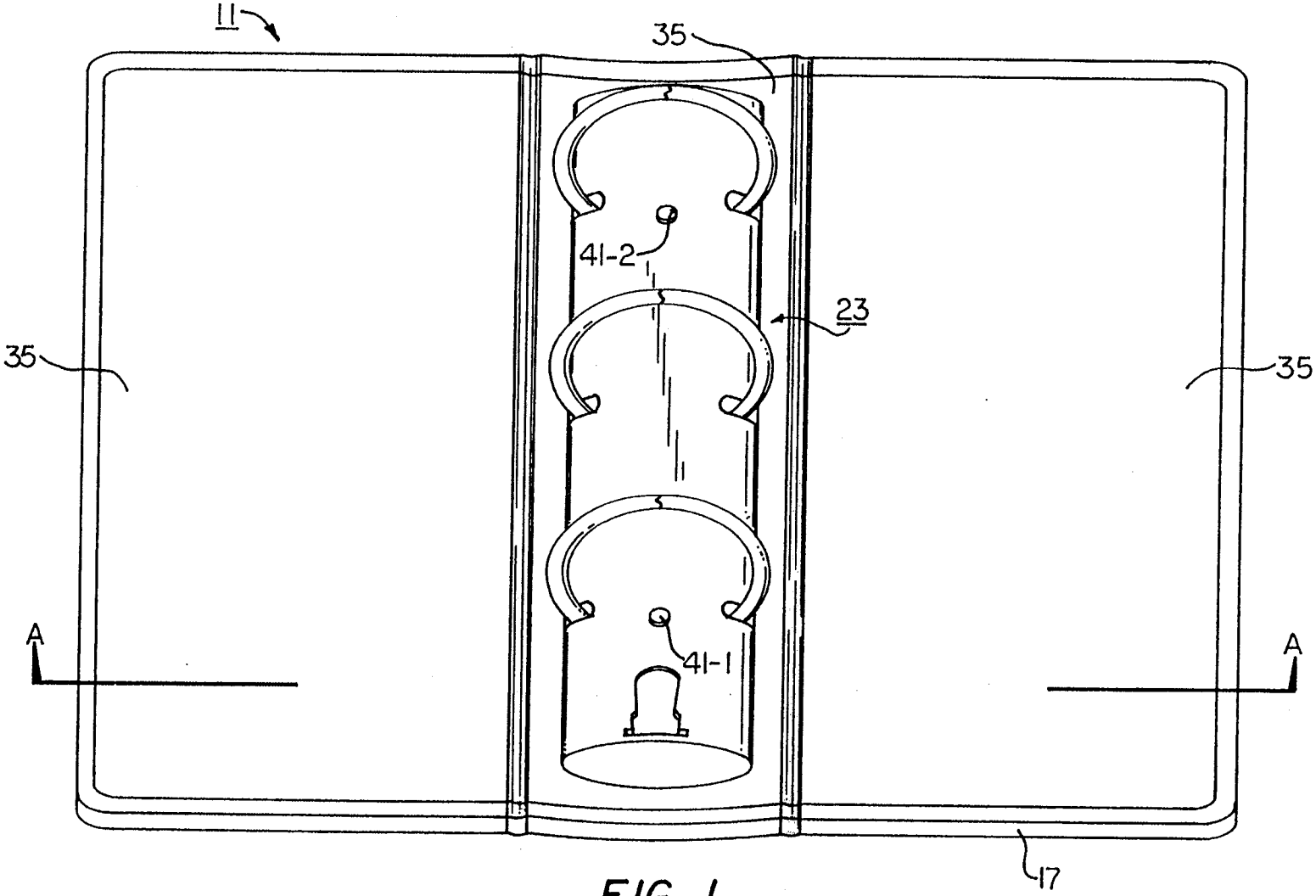
FIG. 1 is a perspective view of one embodiment of a case made ring binder constructed according to the teachings of the present invention.
Figure 2:
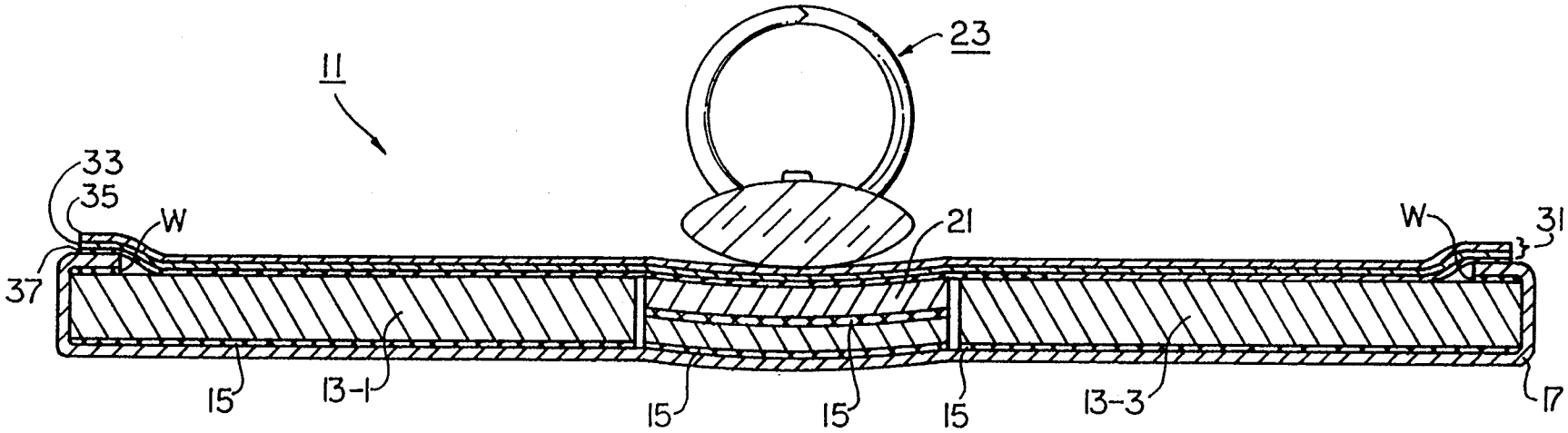
FIG. 2 is a section view of the case made ring binder of this invention taken along line A—A in FIG. 1.
Figure 3:
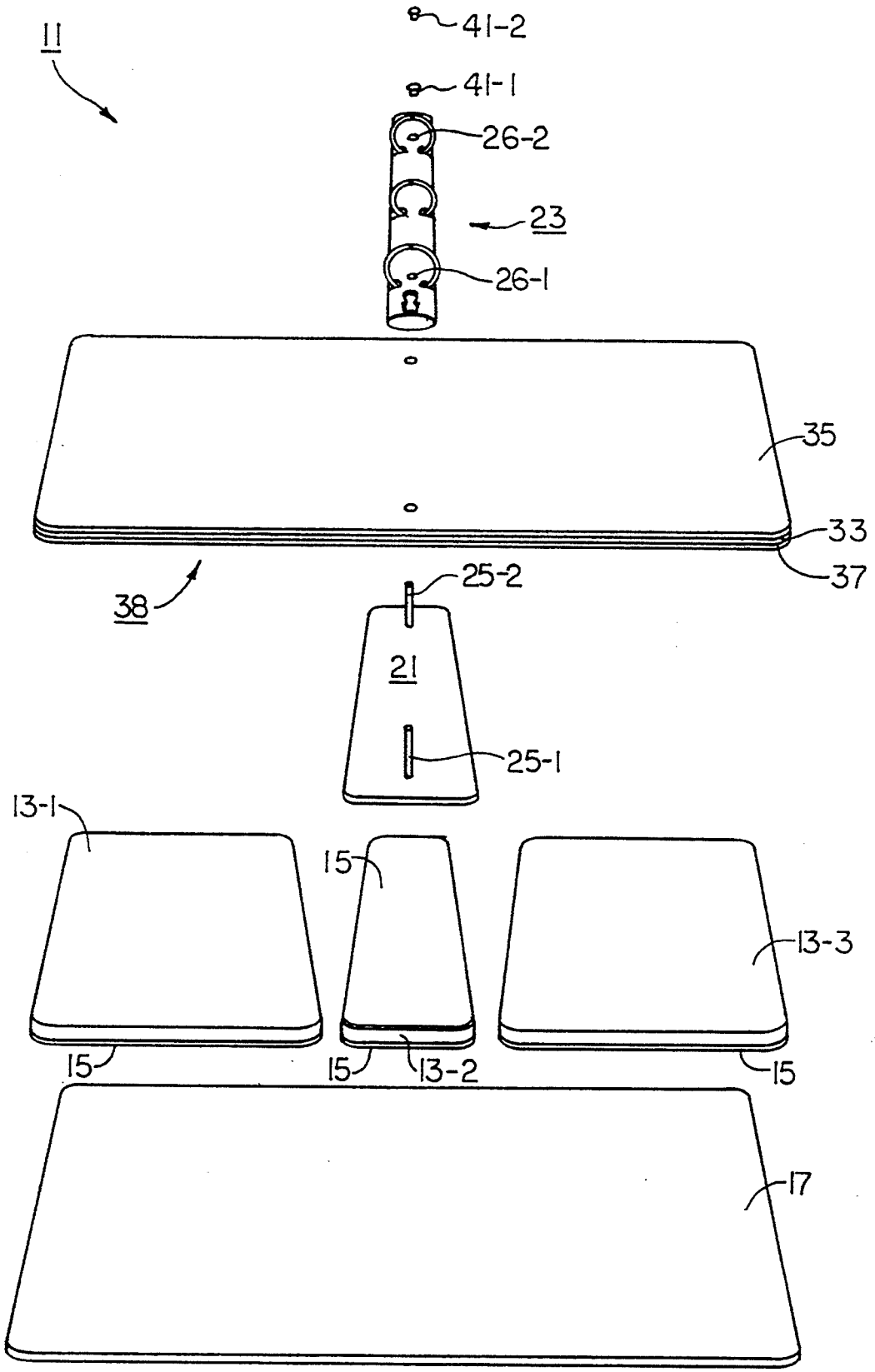
FIG. 3 is a partly exploded perspective view of the components of the case made ring binder shown in FIG. 1, prior to assembly.

Referring now to FIGS. 1 through 3, there are shown various views of a case made ring binder constructed according to the teachings of the present invention, the case made ring binder being represented generally by reference numeral 11. Perspective and section views of binder 11, fully assembled, are shown in FIGS. 1 and 2. An exploded perspective view of the components of binder 11, prior to assembly, is shown in FIG. 3.

Binder 11 includes three stiffener panels 13-1 through 13-3 which may be made of cardboard, chipboard, fiberboard or the like. Stiffener panels 13-1 through 13-3 are appropriately spaced apart and are used to form the front cover 14-1, spine 14-2 and rear cover 14-3, respectively, of binder 11. A dry, heat-actuable adhesive 15, which may be an acyrlic adhesive or the like, is applied to the respective outside (i.e. rear) surfaces of stiffener panels 13-1 through 13-3 and is also applied to the inside (i.e. front) surface of stiffener panel 13-2.

Binder 11 also includes an outer cover sheet 17 which may be made of a rubber saturated paper material coated with a plastic (e.g. acrylic) or may be made from other conventional case made binder cover materials. Cover sheet 17 is appropriately sized so that, when placed over and secured to the respective outside (i.e. rear) surfaces of stiffener panels 13-1 through 13-3, the marginal edges of cover sheet 17 may be turned over the edges of stiffener panels 13-1 through 13-3 and folded down onto the adjacent inside (i.e. front) surfaces of stiffener panels 13-1 through 13-3.

Binder 11 further includes a ring assembly comprising a backplate 21 and a conventional ring mechanism 23. Backplate 21, which may be made of a lightweight yet rigid metal or similar material, is appropriately dimensioned to fit over the inside (i.e. front) surface of stiffener panel 13-2. Backplate 21 includes a pair of mounting posts 25-1 and 25-2 which are insertable through a pair of openings 26-1 and 26-2 provided in ring mechanism 23 for use in mounting ring mechanism 23 to stiffener panel 13-2.

Binder 11 further includes an inside liner sheet 31. Liner sheet 31, in turn, comprises a paper-based substrate 33 and a plastic film 35, film 35 being applied to the inside (i.e. front or top) surface of paper-based substrate 33. Film 35 provides reinforcement to the spine area of binder 11 and may be, for example, a polyester film such as MYLAR, a polyethylene film, a polyethylene-derivative film such as SURLYN (ionomer) or the like.

A dry, heat-actuable adhesive 37, which may be the same type of adhesive as adhesive 15, is applied to the outside (i.e. rear or bottom) surface of paper-based substrate 33 and is used to fix liner sheet 31 to the inturned edges of cover sheet 17, as well as to the underlying exposed portions of backplate 21 and stiffener panels 13-1 and 13-3. Liner sheet 31 with adhesive 37 fixed thereto are jointly identified in FIG. 3 by reference numeral 38.

To assemble binder 11, cover sheet 17 is positioned relative to stiffener panels 13-1 through 13-3 so that the marginal edges of cover sheet 17 can be folded over the corresponding edges of panels 13-1 through 13-3. The adhesive 15 on the outer surfaces of stiffener panels 13-1 through 13-3 is then heat-activated, whereupon cover sheet 17 becomes affixed to stiffener panels 13-1 through 13-3. The marginal edges of cover sheet 17 are then inturned over the inside (i.e. front) surfaces of stiffener panels 13-1 and 13-3 and are affixed thereto with a wet glue W. Backplate 21 is then placed on top of stiffener panel 13-2 (the ends of backplate 21 being inserted under the inturned edges of cover sheet 17 folded stiffener panel 13-2) and is affixed thereto by heat-activating the adhesive 15 disposed on the inside (i.e. front) surface of stiffener panel 13-2. Next, the marginal edges of liner 31 are positioned over the inturned edges of cover sheet 17, and liner 31 is affixed thereto, as well as to the underlying exposed portions of backplate 21 and stiffener panels 13-1 and 13-3, by heat-activating adhesive 37. At the same time, panel 13-2 and backplate 21 are made curved. The simultaneous activation of adhesive 37 and curving of panel 13-2 and backplate 21 may be achieved using a heated press. Finally, ring mechanism 23 is mounted on backplate 21 and fixed thereto with a pair of rivets 41-1 and 41-2.

It should be appreciated that, although binder 11 of the present invention includes a ring assembly adapted for holding loose-leaf sheets, the principles of the present invention could also be applied to other types of casings for books or the like which do not include ring assemblies.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. A case made binder cover comprising:

a) at least one stiffener defining a from cover panel, a back cover panel and a spine panel;

b) a generally rectangular cover sheet affixed to an outside surface of said at least one stiffener, four edges of said cover sheet being turned over corresponding edges of said at least one stiffener; and c) an inside liner sheet appropriately dimensioned so that its marginal edges overlie the four overturned edges of said cover sheet, said inside liner sheet being placed over an inside surface of said at least one stiffener and affixed to the four overturned edges of said cover sheet with a dry, heat-actuable adhesive.

2. A case made ring binder comprising:

a) at least one stiffener defining a front cover panel, a back cover panel and a spine panel;

b) a generally rectangular cover sheet affixed to an outside surface of said at least one stiffener, four edges of said cover sheet being turned over corresponding edges of said at least one stiffener;

c) an inside liner sheet appropriately dimensioned so that its marginal edges overlie the four overturned edges of said cover sheet, said inside liner sheet being placed over an inside surface of said at least one stiffener and affixed to the four overturned edges of said cover sheet with a dry, heat actuable adhesive; and d) a ring mechanism attached to said spine panel.

3. The case made ring binder as claimed in claim 1 wherein said inside liner sheet comprises a paper-based substrate and a plastic reinforcing film applied to a top surface of said paper-based substrate.

4. The case made ring binder as claimed in claim 3 wherein said plastic reinforcing film is selected from the group consisting of a polyester film, a polyethylene film and a polyethylene-derivative film.

5. The case made ring binder as claimed in claim 4 wherein said plastic film is SURLYN (ionomer).

6. The case made ring binder as claimed in claim 2 wherein said at least one stiffener consists of three spaced apart stiffeners arranged as said front cover panel, said back cover panel and said spine panel, respectively.

7. The case made ring binder as claimed in claim 2 wherein said generally rectangular cover sheet is affixed to the outside surface of said at least one stiffener with a dry, heat-actuable adhesive.

8. The case made ring binder as claimed in claim 2 wherein said inside liner sheet is also affixed to the inside surface of said at least one stiffener with a dry, heat-actuable adhesive.

9. A method of manufacturing a case made ring binder comprising the steps of:

a) providing three spaced apart stiffener panels arranged as a front cover panel, a back cover panel and a spine panel, each of .Said three spaced apart stiffener panels having an inside surface and an outside surface;

b) affixing a generally rectangular cover sheet to the outside surfaces of said three spaced apart stiffener panels using a dry-heat actuable adhesive, said generally rectangular cover sheet being appropriately sized so that four edges thereof may be turned over corresponding edges of said three spaced apart stiffener panels;

c) turning four edges of said generally rectangular cover sheet over corresponding edges of said three spaced apart stiffener panels and affixing the overturned edges which overlie the inside surfaces of said front cover panel and said back cover panel to the inside surfaces of said front cover panel and said back cover panel, respectively;

d) providing a backplate having means for mounting a ring mechanism;

e) affixing said backplate to the inside surface of said spine panel using a dry, heat-actuable adhesive;

f) providing an inside liner sheet appropriately dimensioned so that its marginal edges can overlie the four overturned edges of said cover sheet;

g) affixing the marginal edges of said inside liner sheet to the four overturned edges of said cover sheet using a dry, heat-actuable adhesive; and h) mounting a ring mechanism on said backplate.

10. The method as claimed in claim 9 further comprising the step of affixing those portions of said inside liner sheet which overlie said front cover panel, said rear cover panel and said backplate to said front cover panel, said rear cover panel and said backplate using a dry, heat-actuable adhesive.

11. The method as claimed in claim 9 wherein said backplate provided is flat, said method further comprising the step of curving said backplate and said spine panel.

12. The method as claimed in claim 11 wherein affixing the marginal edges of said inside liner sheet and curving said backplate and said spine panel are realized simultaneously.

13. A method of manufacturing a case made ring binder comprising the steps of:

a) providing at least one stiffener defining a front cover panel, a back cover panel and a spine panel;

b) affixing a generally rectangular cover sheet to an outside surface of said at least one stiffener, said generally rectangular cover sheet having four edges and being appropriately sized so that said four edges may be turned over corresponding edges of said at least one stiffener;

c) turning said four edges of said generally rectangular cover sheet over corresponding edges of said at least one stiffener and affixing the overturned edges to an inside surface of said front cover panel and said back cover panel;

d) providing an inside liner sheet appropriately dimensioned so that its marginal edges can overlie the overturned edges of said generally rectangular cover sheet, said marginal edges of said inside liner sheet having an outside surface coated with a dry, heat-actuable adhesive;

e) actuating said dry, heat-actuable adhesive and affixing said marginal edges of said inside liner sheet to the four overturned edges of said generally rectangular cover sheet; and f) attaching a ring mechanism to said at least one stiffener.

* * * * *